US010508495B2

(12) United States Patent
Swinford

(10) Patent No.: US 10,508,495 B2
(45) **Date of Patent: *Dec. 17, 2019**

(54) LINEAR AND VIBRATIONAL IMPACT GENERATING COMBINATION TOOL WITH ADJUSTABLE ECCENTRIC DRIVE

(71) Applicant: Jason Swinford, Spring, TX (US)

(72) Inventor: Jason Swinford, Spring, TX (US)

( * ) Notice: Subject to any disclaimer, the term of this patent is extended or adjusted under 35 U.S.C. 154(b) by 131 days.

This patent is subject to a terminal disclaimer.

(21) Appl. No.: 15/833,143

(22) Filed: Dec. 6, 2017

(65) Prior Publication Data

US 2018/0100355 A1 Apr. 12, 2018

Related U.S. Application Data

(63) Continuation of application No. 15/093,612, filed on Apr. 7, 2016, now Pat. No. 9,869,129.

(51) Int. Cl.

| | |
|---|---|
| ***E21B 17/20*** | (2006.01) |
| ***E21B 31/113*** | (2006.01) |
| ***E21B 31/00*** | (2006.01) |
| ***E21B 4/14*** | (2006.01) |
| ***E21B 7/04*** | (2006.01) |
| ***E21B 7/24*** | (2006.01) |
| ***E21B 31/18*** | (2006.01) |

(52) U.S. Cl.

CPC ..... *E21B 7/24* (2013.01); *E21B 4/14* (2013.01); *E21B 7/04* (2013.01); *E21B 17/20* (2013.01); *E21B 31/005* (2013.01); *E21B 31/113* (2013.01); *E21B 31/18* (2013.01)

(58) Field of Classification Search

CPC ..... E21B 17/20; E21B 4/14; E21B 31/00

See application file for complete search history.

(56) References Cited

U.S. PATENT DOCUMENTS

| | | | | |
|---|---|---|---|---|
| 2,943,603 | A * | 7/1960 | Bassinger | E21B 4/14 173/1 |
| 9,038,744 | B2 † | 5/2015 | Swinford | |
| 9,885,212 | B2 † | 2/2018 | Swinford | |
| 2004/0140131 | A1 * | 7/2004 | Susman | E21B 4/14 175/296 |
| 2012/0211251 | A1 * | 8/2012 | Konschuh | E21B 28/00 173/201 |
| 2015/0211317 | A1 † | 7/2015 | Swinford | |

* cited by examiner
† cited by third party

*Primary Examiner* — Kristyn A Hall
*Assistant Examiner* — Dany E Akakpo
(74) *Attorney, Agent, or Firm* — Eric P. Mirabel, LLM

(57) ABSTRACT

Disclosed combination impact tool generates optimized linear hammering and vibrational impacts. Flow of pressurized fluid through an upper section of the tool generates linear hammering impacts, and flow of pressurized fluid through a lower section of the tool generates vibrational impacts. Flow of pressurized fluid through the lower section induces an eccentric arm to rotate and cause vibrational impacts. While frequency of hammering impacts can be controlled by varying pressure of the fluid flowing through the upper section, the frequency and amplitude of vibrational impacts can be controlled by varying weight of the eccentric arm and by varying pressure of the fluid flowing through lower section.

20 Claims, 6 Drawing Sheets

LINEAR AND VIBRATIONAL IMPACT GENERATING COMBINATION TOOL WITH ADJUSTABLE ECCENTRIC DRIVE

BACKGROUND

Oil wells are generally formed by drilling a bore into the earth for accessing buried crude oil deposits, and then installing a variety of equipment within the bore to enable pumping of crude oil up to the earth's surface. During drilling, hollow metallic tubes (also known as "casings") are inserted within the bore to prevent walls of bore from collapsing. In a deep enough bore, multiple hollow casings are installed vertically one above the other by screwing ends of adjacent sections with each other. The entire assembly of attached casings is commonly known as "bore casing."

Once a bore casing is formed, a variety of equipment (including crude oil pumping equipment and sensor equipment) is installed within the bore casing. In an operational oil well, crude oil is pumped to the surface of the earth from the buried crude oil deposits with the help of pumping equipment installed in the bore casing.

However, the process of drilling an oil well-bore, installing equipment in it and even operating an existing well-bore are vulnerable to a variety of problems. For example, during drilling, the drilling equipment may fail to perform due to a snag or the coiled tubing (or drill string) may simply get stuck in the bore due to changed earth conditions within the bore. Additionally, with advanced recovery techniques, after being drilled vertically to a certain depth, the bore is often turned and extended on a horizontal route within the earth. Drilling a vertical to horizontal route is challenging and is more vulnerable to both sticking and to failure of equipment. Thus, the drill string often includes a jar, which is a device providing linear hammer impacts during drilling, to help free the stuck drill string or stuck equipment. See e.g. U.S. Pat. No. 8,151,910 (incorporated by reference).

Coiled tubing can be used for directional drilling as well as equipment recover. In one application of coiled tubing in directional drilling, a mud motor is used to create a system for drilling reservoirs. Bottom hole assemblies (BHAs) are now able to drill directional, S-curve and horizontal wells and can be the key to unlocking reserves in mature oilfields via re-entry drilling. Coiled tubing drilling is known for its speed and ability to drill reservoirs in an underbalanced condition and for directional applications, and for its ability to reduce drilling times between 30%-60% compared with conventional jointed pipe drilling rigs. Therefore, its use in directional drilling can provide significant economic benefits.

Coiled tubing rides out on a powered drum during drilling or equipment recovery operations. In addition to a jar, the coiled tubing drill string may include an oscillating tool. See e.g. US Publ'n No. 20150211317 (incorporated by reference). While the impact hammer of a jar provides linear hammering impacts, the oscillating tool provides vibrational impacts to assist in opening a path for the drill string during drilling, or freeing of target equipment during recovery. Nevertheless, if a portion of coiled tubing (which is generally flexible) connects the jar (including an impact hammer) and the oscillating tool, some of the generated impacts get dampened. This can reduce the intended effect of these tools.

Though some currently known coiled tubing tool assemblies claim to facilitate drilling and liberation of target equipment, the damping noted above takes place and negatively affects effectiveness of generated linear/vibrational impacts. Additionally, improperly controlled generation of linear/vibrational impacts can result in impacts either be too weak for efficient drilling or so large as to cause excessive caving-in around the drill string. This effect may be exacerbated while turning a drill string (to drill horizontally or otherwise) through shale (which is softer than bedrock). More specifically, adjusting the frequency and amplitude of vibrational impacts generated by the oscillating tool can significantly enhance directional drilling. Also, in a recovery operation, if the frequency and amplitude of vibrational impacts is too large, it may cause disturbances on surroundings and can even damage the target equipment.

Hence, additional and improved means for adjustment and tuning of the vibrational impacts is a desirable feature of tools for directional drilling or recovery operations.

SUMMARY

The invention is a combination impact tool for generating a combination of linear hammering and vibrational impacts. When included in coiled tubing of an oil well-bore, the combination impact tool of the present invention is useful for drilling and fishing operations. The combination impact tool is driven by pressurized fluid (which could be drilling fluid) flowing through it, and the impacts generated by the tool can be optimized as described herein and depending on the specific application.

For generation of linear hammering impacts, an upper section of the tool includes a hammer driving mechanism which when powered by the flow of pressurized fluid through it, causes a hammer bit to strike an anvil. A set-up of amplification springs along with the hammer bit and anvil assembly further assists in generating amplified linear hammering impacts. Due to provisions for amplification of generated linear hammering impacts, the upper section is able to produce powerful linear hammering impacts through a relatively smaller distance travelled by the hammer (before striking the anvil) than in prior tools.

For generation of vibrational impacts, a lower section of the tool includes a rotation generating mechanism which when powered by the flow of pressurized fluid through it, causes an eccentric drive to rotate an eccentric arm about an axis of the eccentric drive. Since the mass of the eccentric arm is distributed asymmetrically around the axis, rotation of eccentric arm causes the entire tool to vibrate. The eccentric arm further includes provisions for including additional mass/weight. By varying mass of the eccentric arm, the frequency and amplitude of generated vibrational impacts can be varied. While frequency of linear hammering impacts is controlled by varying pressure of the pressurized fluid flowing through the upper section of the tool, the frequency and amplitude of the vibrational impacts generated by the tool can be controlled by varying weight of the eccentric arm and/or by varying pressure of the pressurized fluid flowing through the lower section.

Described features make the combination impact tool particularly useful for drilling through shale. Since shale is very sensitive and is more prone to collapsing, drilling through shale is enhanced if frequency of linear hammering impacts and frequency and amplitude of vibrational impacts are optimized. An optimized mix of linear and vibrational impacts can avoid excessive caving-in around the drill string or around the drilling tool. Additionally, combination impact tool is also useful in fishing of stuck objects within a well-bore. During fishing operations, the combination impact tool is better at safe and quick liberation of the target object.

Embodiments of the present invention will be discussed in greater details with reference to the accompanying figures in the detailed description which follows.

Figure 1:
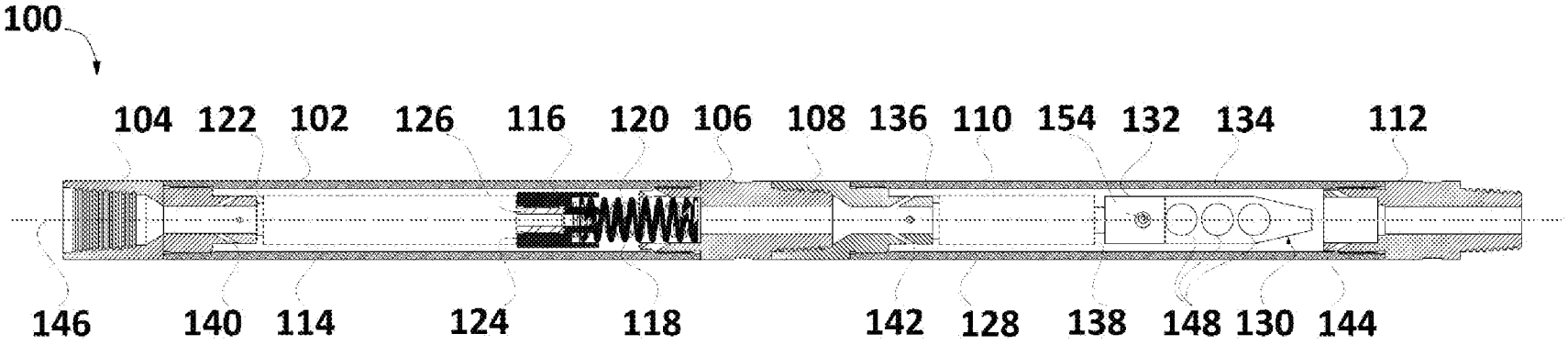
FIG. 1 is a cross-sectional view along the axis of a first embodiment of a combination impact tool.
Figure 2:
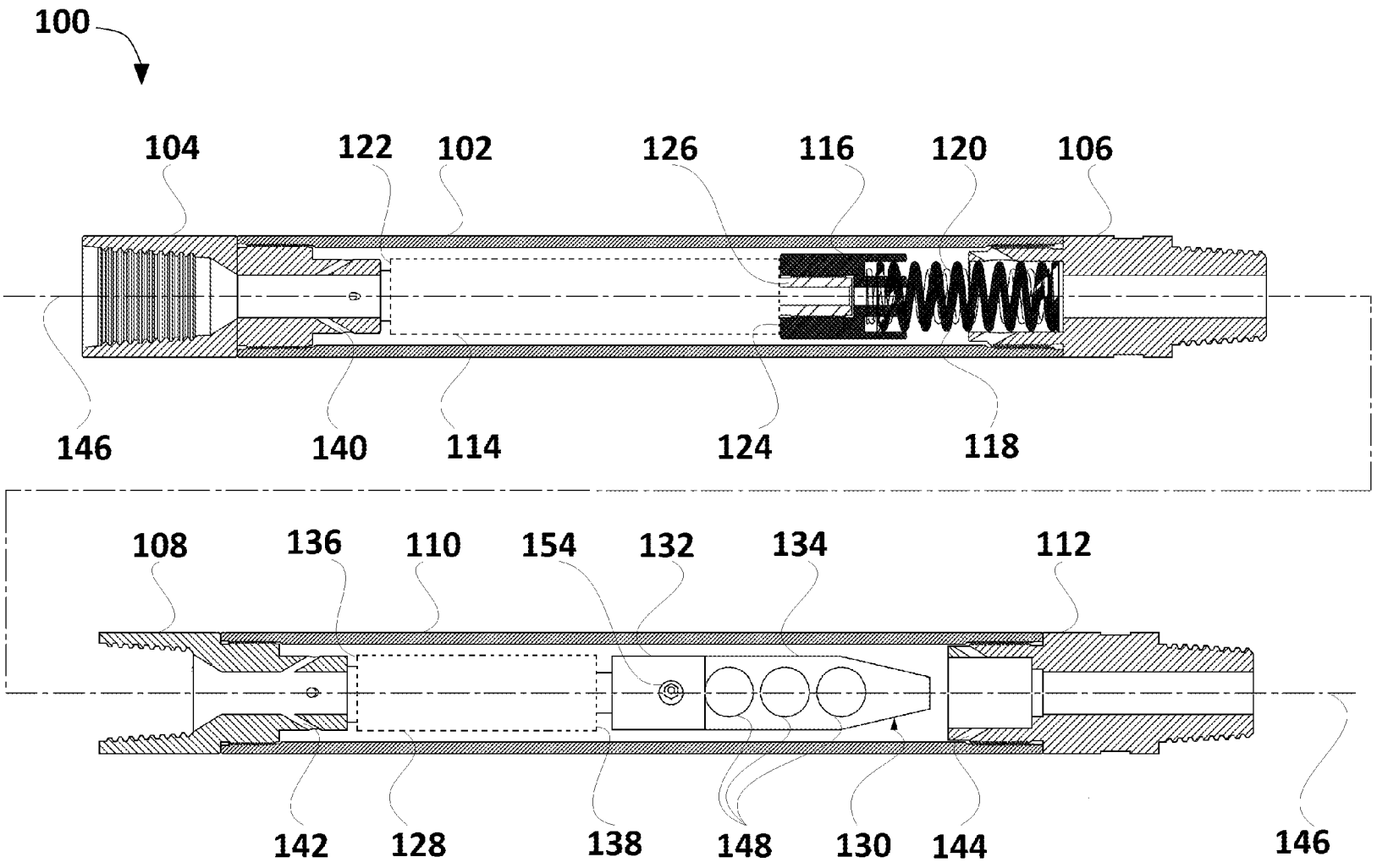
FIG. 2 is a cross-sectional view along the axis of the first embodiment of the combination impact tool with its upper and lower sections separated by detaching an anvil and a middle sub.

It should be understood that the drawings and the associated descriptions below are intended and provided to illustrate one or more embodiments of the present invention, and not to limit the scope of the invention. Also, it should be noted that the drawings are not be necessarily drawn to scale.

DETAILED DESCRIPTION

Reference will now be made in detail to a first embodiment of a combination impact tool of the invention with reference to the accompanying FIGS. 1 to 4. As illustrated in these figures, combination impact tool 100 comprises an upper barrel 102, an upper sub 104, an anvil 106, a middle sub 108, a lower barrel 110 and a lower sub 112. The upper sub 104 and the anvil 106 are screwed to either ends of the upper barrel 102. The middle sub 108 is connected to the anvil 106 and to one end of the lower barrel 110 as illustrated. The other end of the lower barrel 110 is connected to the lower sub 112.

The upper barrel 102 further surrounds a hammer driving mechanism 114, a hammer bit 116 and amplification springs 118 and 120. While an input end 122 of the hammer driving mechanism 114 is connected to the upper sub 104, an impact end 124 of the hammer driving mechanism 114 is connected to the hammer bit 116 through a mandrel 126. Amplification springs 118 and 120 are connected between the hammer bit 116 and the anvil 106.

The lower barrel 110 further surrounds a rotation generating mechanism 128 and an eccentric drive 130. The eccentric drive 130 includes a cylindrical shaft 132 and an eccentric arm 134. While an input end 136 of the rotation generating mechanism 128 is connected to the middle sub 108, a torque end 138 of the rotation generating mechanism 128 is connected to the cylindrical shaft 132 of the eccentric drive 130.

The combination impact tool 100 is driven by pressurized fluid which enters it through the upper sub 104 and exits through the lower sub 112. While the upper sub 104, the hammer driving mechanism 114 the anvil 106, the middle sub 108, the rotation generating mechanism 128, the lower barrel 110 and the lower sub 112 provide passage for the pressurized fluid to flow through, bores 140, 142 and 144 assist in preventing excessively pressurizing the fluid beyond pre-defined limits. On being driven by a flow of pressurized fluid, the combinational tool 100 generates both the linear hammering impacts and vibrational impacts. When the combination impact tool 100 is used in a coiled tubing assembly of an oil well-bore being drilled, the upper sub 104 would attach to the coiled tubing (not shown) and lower sub 112 would attach to a drilling tool through added coil tubing (not shown).

In combination impact tool 100, the assembly of the upper sub 104, the upper barrel 102, the hammer driving mechanism 114, the mandrel 126, the hammer bit 116, the anvil 106 along with the amplification springs 118 and 120 form an upper section. When powered by the flow of pressurized fluid through the combination impact tool 100, the upper section generates linear hammering impacts. Internal structure, components included within the hammer driving mechanism 114, and functioning within the upper section along with the hammer bit 116, the anvil 106 and the amplification springs 118 and 120 to generate amplified linear hammering impacts is similar to those described in US Publ'n No. 20150211317 (incorporated herein by reference), and is not shown in FIGS. 1 and 2. In summary, after entering through upper sub 104, the pressurized fluid flows through the hammer driving mechanism 114 and drives it to causes the hammer bit 116 to strike the anvil 106. The set-up of amplification springs 118 and 120 along with the hammer bit 116 and anvil 106 further assists in generating amplified linear hammering impacts. Due to provisions for amplification of generated linear hammering impacts, the upper section is able to produce powerful linear hammering impacts where a relatively smaller distance is travelled by the hammer bit 116 before striking the anvil 106, than is conventional. A constant flow of the pressurized fluid through combination impact tool 100 leads to generation of continuous linear bi-directional hammering impacts.

Further, in the combination impact tool 100, the assembly of the middle sub 108, the lower barrel 110, the rotation generating mechanism 128, the eccentric drive 130 and the lower sub 112 form a lower section. After driving the hammering impacts, pressurized fluid exits the anvil 106 to enter rotation generating mechanism 128 through the middle sub 108 for powering the generation of vibrational impacts in the lower section. When powered by the flow of pressurized fluid, the rotation generating mechanism 128 generates torque for the eccentric drive 130 to rotate on its axis (which is same as a longitudinal axis 146 of the combination impact tool 100). As mentioned, eccentric drive 130 includes a cylindrical shaft 132 and an eccentric arm 134. While the mass of cylindrical shaft 132 is symmetrically distributed around the axis 146 (or the axis of rotation of eccentric drive 130), the mass of eccentric arm 134 is asymmetrically distributed it. Due to the presence of eccentric arm 134, when eccentric drive 130 rotates it causes the entire combination impact tool 100 to undergo oscillatory vibrations. The Internal structure and components of the rotation generating mechanism 128 and is functioning to produce torque for rotating eccentric drive 130 is similar to that described in US Publ'n No. 20120247757 (incorporated herein by reference), and therefore, rotation generating mechanism 128 are not illustrated in FIGS. 1 and 2.

While linear hammering impacts are generated through the upper section by impacts between components surrounded by the upper barrel 102, vibrational impacts are generated through the lower section by the components surrounded by the lower barrel 110. Both linear hammering impacts generated within the upper barrel 102 and vibrational impacts generated within the lower barrel 110 are driven by pressurized fluid (or drilling fluid) supplied to the combination impact tool 100 from the coiled tubing. The pressurized fluid enters the combination impact tool 100 from upper sub 106, travels through the barrels 102 and 110 and exits through the end of lower sub 112.

Figure 3A:
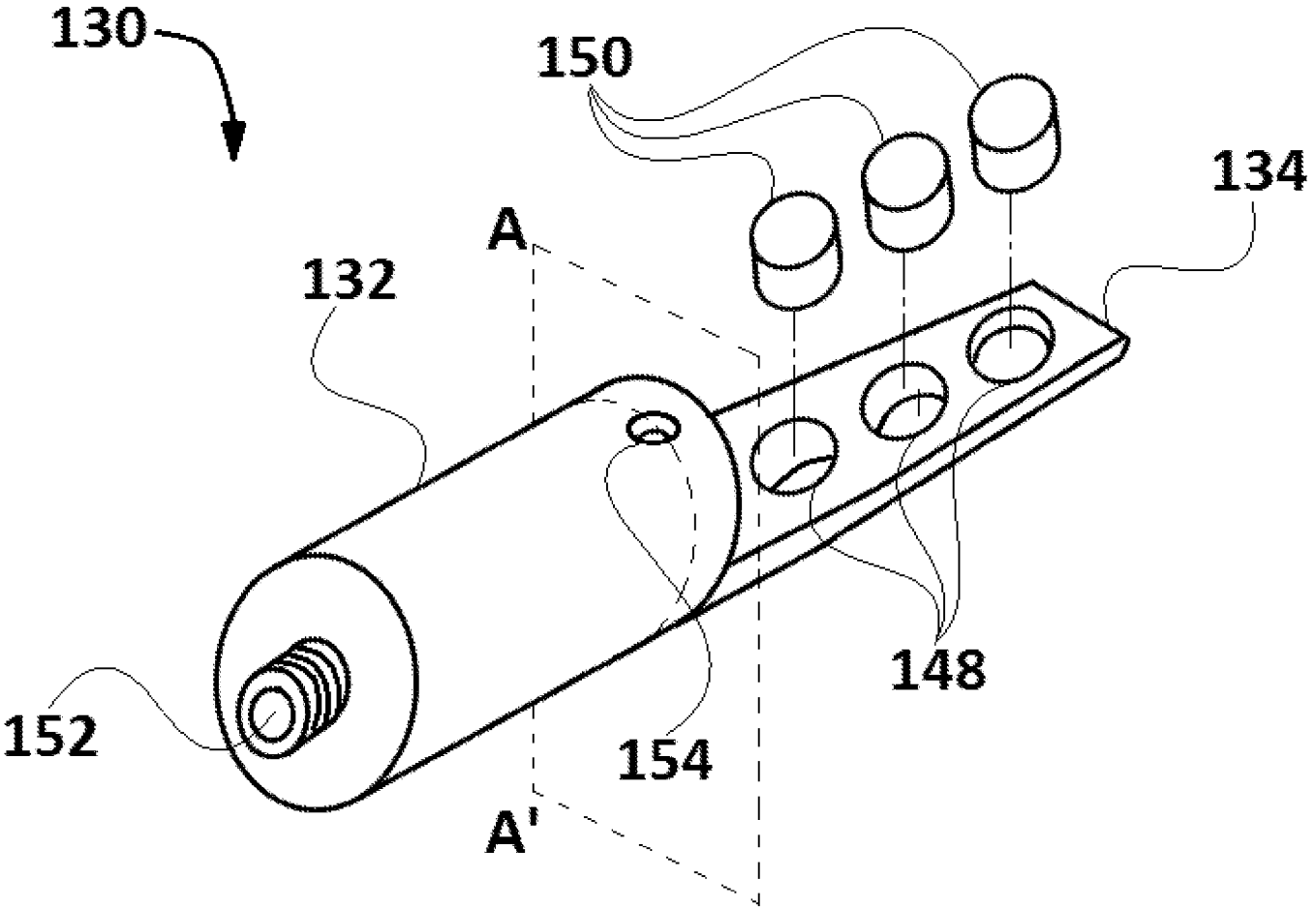
FIGS. 3A and 3B illustrate perspective views of an eccentric drive used in the first embodiment of the present invention.
Figure 3B:
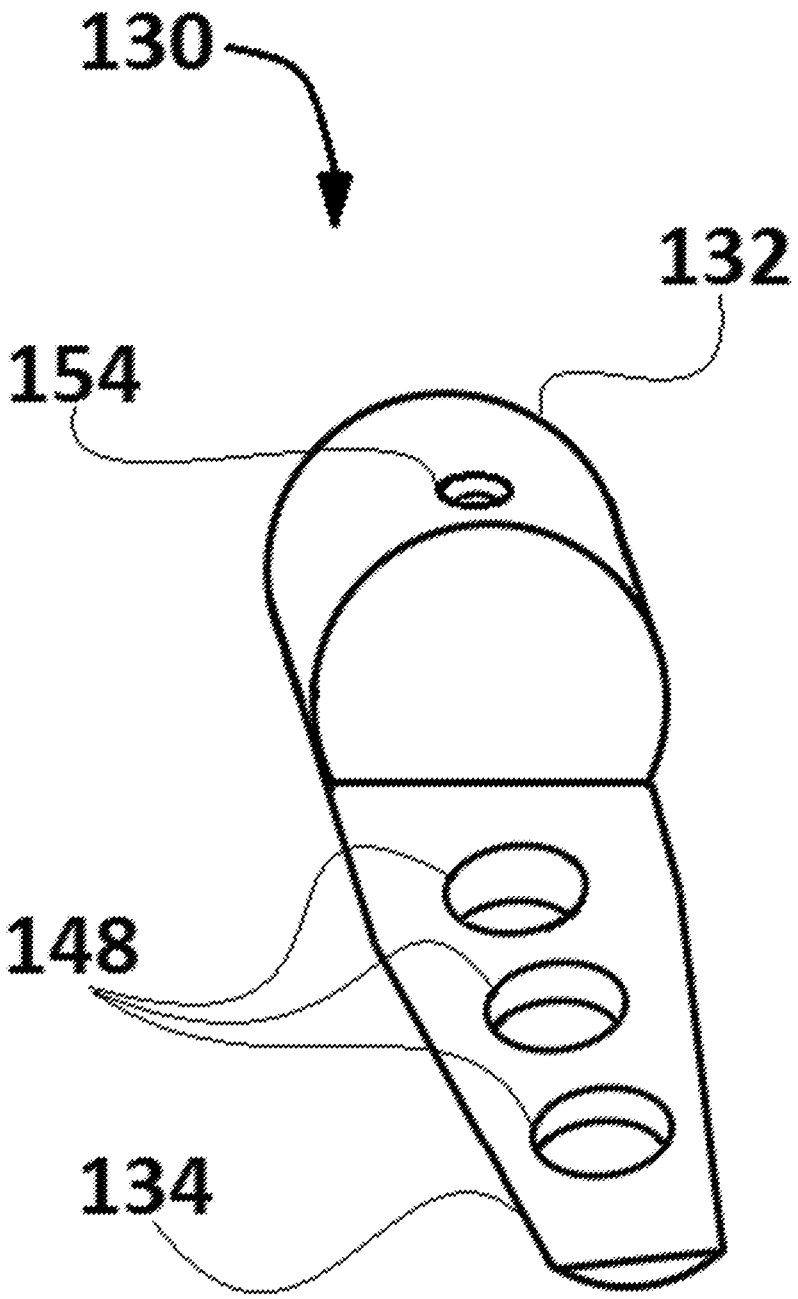
Figure 4:
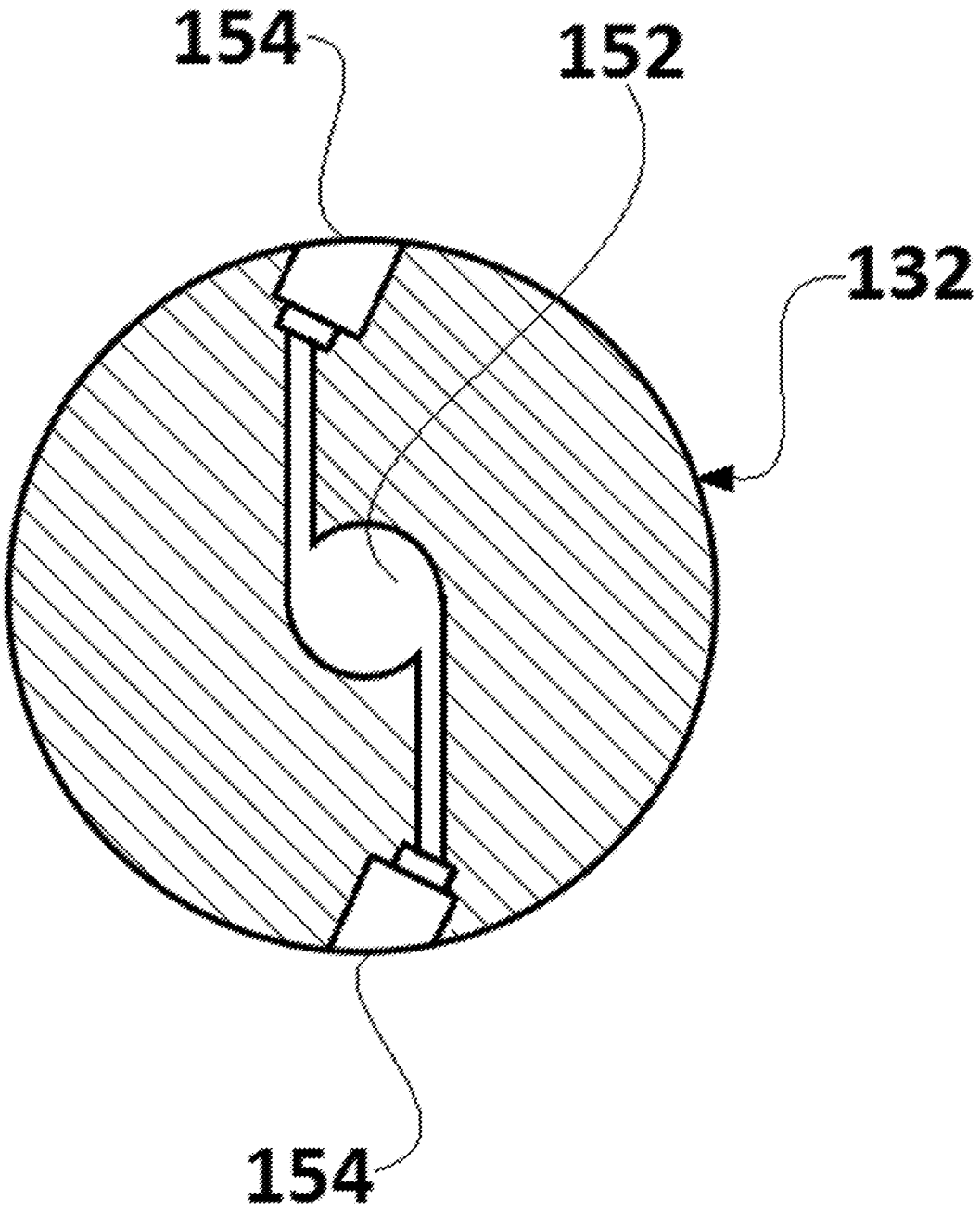
FIG. 4 provides a cross-sectional view of a cylindrical shaft of eccentric drive taken along plane A-A' as illustrated in FIG. 3A

The mass distribution of eccentric arm 134 can be varied. In one embodiment, the eccentric arm includes three slots 148 in which one or more of additional weights 150 (illustrated in FIGS. 3A and 3B) can be placed. Increasing or decreasing the mass of eccentric arm 134 has direct effect on amplitude and frequency of vibrational impacts generated by the combination impact tool 100. Functionally, the frequency and amplitude of oscillatory vibrations generated by the lower section, can be controlled by either adjusting the pressure of pressurized fluid flowing through the combination impact tool 100, or by adjusting the amount of mass carried by eccentric arm 134. The cylindrical shaft 132 further includes a bore 152 (illustrated in FIG. 3A) in which the pressurized fluid ejected by rotation generating mechanism 128 enters. Within the cylindrical shaft 132, bore 152 splits in two channels which open at two diametrically opposite holes 154 on the surface of cylindrical shaft 132. A cross-sectional view of the cylindrical shaft 132 taken along a plane A-A' (illustrated in FIG. 3A) is provided in FIG. 4. It is to be noted that plane A-A' is perpendicular to axis of rotation of the eccentric drive and passes symmetrically through holes 142 is shown in FIG. 3A. As illustrated in FIG. 4, holes 154 and their corresponding channels which connect them to bore 152 are oriented such that the pressurized fluid which enters the bore 152, flows into the channels and exits through holes 154 by generating a rotational torque on the cylindrical shaft 132. The torque hence produced further drives the rotating of the eccentric drive 130.

The combination impact tool 100 can provide a mix of appropriate linear hammering and vibrational impacts needed for drilling tool for drilling an oil well-bore. Additionally, the impacts generated by the combination impact tool 100 can be optimized to suit the immediate requirements. Based on the requirements of the drilling site and environment of the drilling set-up (such as desired bore diameter, type of drilling tool, depth at which drilling is to be done, and data relating to rocks through which a bore is to be drilled), the combination impact tool 100 can be set to provide linear hammering impacts having pre-selected frequency, and vibrational impacts with pre-selected frequency and amplitude. For example, if a well-bore is to be drilled through a relatively softer layer of rocks it is important ensure that drilling tool is powered just enough so that it drills to the target and does not cave or spoil the surroundings excessively. In this case, it is preferred that the vibrational impacts provided to the drilling tool should be smaller in amplitude but higher in frequency. To provide such vibrational impacts through the combination impact tool 100, the mass of eccentric arm 134 is reduced suitably by removing weights 150 from slots 148. When rotated, a relatively lighter eccentric arm 134, would generate vibrations of lesser amplitude but higher in frequency. Additional control over frequency of linear hammering impacts, and frequency and amplitude vibrational impacts can be achieved by controlling the pressure pf the pressurized fluid flowing through the combination impact tool 100. Such features make the combination impact tool 100 is particularly useful for drilling a well-bore in regions subject to caving-in, such as in a layer of shale within the earth. Since shale is very sensitive and is more prone to collapsing, drilling through shale is enhanced if frequency of linear hammering impacts and frequency and amplitude of vibrational impacts are optimized. An optimized mix of linear and vibrational impacts can avoid excessive caving-in around the drill string or around the drilling tool.

Figure 5:
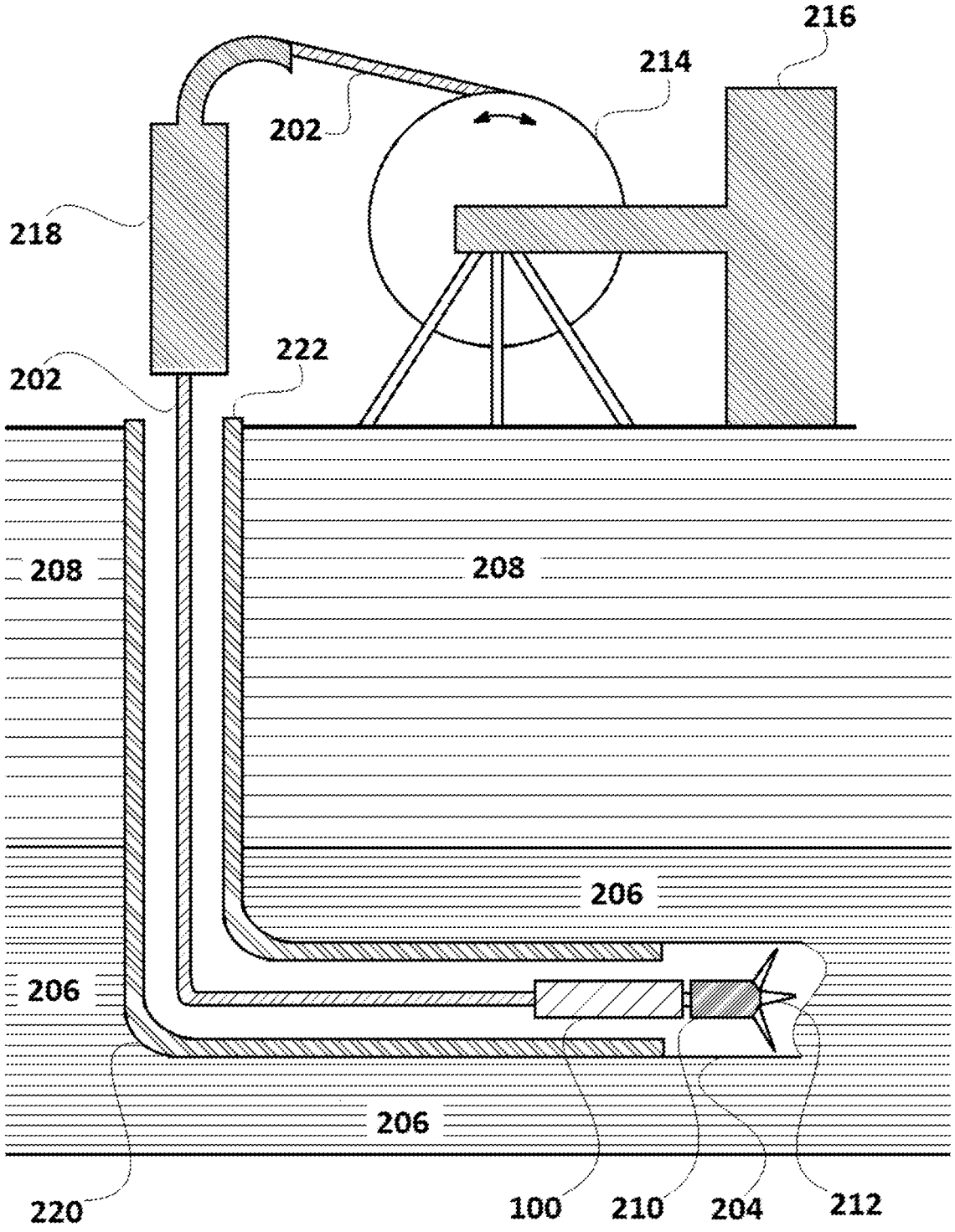
FIG. 5 illustrates a coil tubing drive assembly and drilling tool combination with the combination impact tool provided by the first embodiment of the present invention.

FIG. 5 illustrates an assembly of coil tubing 202 for drilling a vertical-to-horizontal oil well-bore 204 through layer of Shale 206 lying under upper layers 208 of the earth. For drilling and extending the well-bore 204 horizontally through layer of Shale 206, the coil tubing 202 connected to the combination impact tool 100 and a drilling tool 210 (having drill bits 212) is reeled from a drum 214 by a drive motor 216 and an injector 218 in to the well-bore 204. The coil tubing 202, the combination impact tool 100, the drilling tool 210 and the drum 214 (being driven by motor 216 and an injector 218) form a drilling combination. After achieving a certain vertical depth, the coil tubing 202 is diverted to take a corner turn 220 and generate a substantially horizontal portion of well-bore 204 through the layer of shale 206 as illustrated. For enabling an optimized drilling, the combination impact tool 100 provides linear hammering and vibrational impacts (which are optimized for drilling through Shale) to the drilling tool 210. The drilled portion of oil well-bore is fortified by bore casing 222. As noted above, since horizontal drilling through layer of shale 206 (which is more prone to collapsing) requires careful selection of an optimized mix of linear hammering impacts and vibrational impacts (with good control over frequency of linear hammering impacts, and amplitude and frequency of vibrational impacts), the combination impact tool 100 is particularly suitable for such drilling applications.

Under an additional application, the combination impact tool 100 can further be used for safe fishing of a stuck object (say, a target equipment) lying within an oil well-bore. In such operations, coiled tubing is attached to a fishing tool (which is generally an overshot equipped with grasping jaws) through the combination impact tool 100 to form a fishing combination. Thereafter the fishing combination is reeled into the well-bore towards the target equipment and the overshot is placed in proximity with the target equipment. In the next step, the combination impact tool 100 is operated to liberate the target equipment by providing optimized mix of linear and vibrational impacts to it through the overshot. Finally, when the target equipment gets liberated, the jaws of the overshot are operated to grasp the target equipment and the coiled tubing is pulled up to bring the target equipment (grasped in jaws of the overshot) to the surface. Depending on the requirements (such as type of target equipment to be fished, level of trap, immunity of equipment surrounding the target equipment towards shock waves and impacts), the combination impact tool 100 can be set to provide vibrational impacts having pre-selected frequency and amplitude, and linear hammering impacts having pre-selected frequency. Such optimized impacts would be just enough for safe and quick liberation of the target equipment without causing much damage to the surroundings. For example, in addition to linear hammering impacts, liberation of a target equipment which lies too deeply stuck in the well-bore would require vibrational impacts of high amplitude and high frequency. Similarly, liberation of a target equipment which is not too deeply stuck but is surrounded by delicate equipment within the well-bore would require impacts of smaller amplitude but higher frequency of vibrational impacts. The combination impact tool 100 can be set to provide such optimizations in its impacts and is particularly useful for safe and quick fishing operations.

It is to be understood that the foregoing description and embodiments are intended to merely illustrate and not limit the scope of the invention. Other embodiments, modifications, variations and equivalents of the invention are apparent to those skilled in the art and are also within the scope of the invention, which is only described and limited in the claims which follow, and not elsewhere.

What is claimed is:

1. A method of directional drilling through shale with coil tubing, comprising:

attaching a combination impact tool, said combination impact tool attached to a drilling tool, to one end of a length of coil tubing which is wound around a drum to form a drilling combination;

drilling a non-vertical well-bore in shale by providing linear and vibrational impacts to drilling equipment through the combination impact tool, wherein both the linear hammering impacts and vibrational impacts are generated by pressurized fluid flowing from above and through the combination impact tool, wherein an upper section of the combination impact tool includes a poppet valve which continuously opens and closes a fluid pathway through the combination impact tool as pressurized fluid flows through the upper section, and closing of the fluid pathway causes compression of a main spring, and opening of the fluid pathway allows decompression of the main spring such that said decompression carries upwardly a hammer bit and generates linear hammering impacts, and wherein frequency of said linear hammering impacts is controlled by varying pressure of the pressurized fluid flowing through the upper section which thereby controls the rate of opening and closing of the poppet valve, and flow of pressurized fluid through a lower section of said combination impact tool induces an eccentric arm included in the lower section to rotate and cause vibrational impacts, wherein the frequency and amplitude of said vibrational impacts can be controlled by varying weight of the eccentric arm and by varying pressure of the pressurized fluid flowing through the lower section.

2. The method of claim 1, wherein mass of said eccentric arm is distributed asymmetrically around said arm's axis of rotation.

3. The method of claim 1, wherein mass of said eccentric arm rotates around a longitudinal axis of the combination impact tool.

4. The method of claim 1, wherein the eccentric arm includes slots for weights to be added.

5. The method of claim 1, wherein said upper section includes amplification springs for generating amplified linear hammering impacts.

6. The method of claim 1, wherein the pressurized fluid enters the impact tool through the upper section and exits the combination impact tool through the lower section.

7. The method of claim 1, wherein said drilling is done by reeling the drilling combination from the drum with a drive motor into the well-bore being drilled.

8. The method of claim 7, wherein the pressurized fluid enters the impact tool through the upper section and exits the combination impact tool through the lower section.

9. A method of fishing to remove a stuck object from a well-bore, comprising:

attaching a combination impact tool, said a combination impact tool attached to a fishing tool, to one end of a length of coil tubing which is wound around a drum to form a fishing combination;

reeling the coil tubing from the drum with a drive motor down into a well-bore;

operating the combination impact tool to generate a combination of linear and vibrational impacts and transferring the generated impacts to the object, dislodging said object by application of transferred linear and vibrational impacts;

operating the coil tubing cause the fishing tool to grasp the object, wherein both the linear hammering impacts and vibrational impacts are generated by pressurized fluid flowing through the combination impact tool, wherein flow of pressurized fluid through an upper section of the combination impact tool causes a hammer bit to generate linear hammering impacts, and wherein frequency of said linear hammering impacts is controlled by varying pressure of the pressurized fluid flowing through the upper section, and flow of pressurized fluid through a lower section of said combination impact tool induces an eccentric arm included in the lower section to rotate and cause vibrational impacts, wherein the frequency and amplitude of said vibrational impacts can be controlled by varying weight of the eccentric arm and by varying pressure of the pressurized fluid flowing through the lower section, and fishing the object by reeling up the coiled tubing.

10. The method of claim 9 wherein, said fishing tool is an overshot.

11. The method of claim 9 wherein said fishing tool is operated by the coiled tubing to grasp the object.

12. The method of claim 9, wherein mass of said eccentric arm is distributed asymmetrically around said arm's axis of rotation.

13. The method of claim 9, wherein mass of said eccentric arm rotates around a longitudinal axis of the combination impact tool.

14. The method of claim 9, wherein the eccentric arm includes slots and wherein weight are added into the slots.

15. A combination impact tool for generating a combination of linear hammering and vibrational impacts, said combination impact tool comprising:

an upper section and a lower section, wherein both the linear hammering impacts and vibrational impacts are generated by pressurized fluid flowing from above through the combination impact tool, wherein the upper section includes a poppet valve which continuously opens and closes a fluid pathway through the combination impact tool as pressurized fluid flows through the upper section, and closing of the fluid pathway causes compression of a main spring, and opening of the fluid pathway allows decompression of the main spring such that said decompression carries upwardly a hammer and causes said hammer to strike an anvil, and thereby generate repeating linear hammering impacts, and wherein frequency of said repeating linear hammering impacts is controlled by varying pressure of the pressurized fluid flowing through the upper section, and flow of pressurized fluid through the lower section induces an eccentric arm included in the lower section to rotate and cause vibrational impacts, wherein the frequency and amplitude of said vibrational impacts can be controlled by varying weight of the eccentric arm and by varying pressure of the pressurized fluid flowing through the lower section.

16. The combination impact tool of claim 15, wherein mass of said eccentric arm is distributed asymmetrically around said arm's axis of rotation.

17. The combination impact tool of claim 15, wherein mass of said eccentric arm rotates around a longitudinal axis of the combination impact tool.

18. The combination impact tool of claim 15, wherein the eccentric arm includes slots for weights to be added.

19. The combination impact tool of claim 15, wherein said upper section includes amplification springs for generating amplified linear hammering impacts.

20. The combination impact tool of claim 15, wherein the pressurized fluid enters the combination impact tool through the upper section and exits the impact tool through the lower section.

* * * * *